US007207383B2

(12) United States Patent
Hurst et al.

(10) Patent No.: US 7,207,383 B2
(45) Date of Patent: Apr. 24, 2007

(54) MULTIPLE ENTRANCE SHUNT

(75) Inventors: Gary D. Hurst, Lake Jackson, TX (US); David R. Mandeville, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 418 days.

(21) Appl. No.: 10/372,534

(22) Filed: Feb. 21, 2003

(65) Prior Publication Data

US 2003/0159825 A1 Aug. 28, 2003

Related U.S. Application Data

(60) Provisional application No. 60/359,568, filed on Feb. 25, 2002.

(51) Int. Cl.
*E21B 17/00* (2006.01)

(52) U.S. Cl. ..... 166/242.3; 166/242.1; 166/51; 138/116

(58) Field of Classification Search ..... 166/51, 166/242.3, 242.1, 56, 380; 138/116, 111
See application file for complete search history.

(56) References Cited

U.S. PATENT DOCUMENTS 5,113,935 A 5/1992 Jones et al.
5,497,809 A * 3/1996 Wolf ..... 138/113
5,560,427 A 10/1996 Jones
5,588,487 A * 12/1996 Bryant ..... 166/51
5,842,516 A 12/1998 Jones
6,298,916 B1 10/2001 Tibbles et al.
6,409,219 B1 * 6/2002 Broome et al. ..... 285/3
6,516,881 B2 * 2/2003 Hailey, Jr. ..... 166/278
6,634,388 B1 * 10/2003 Taylor et al. ..... 138/114
6,752,207 B2 * 6/2004 Danos et al. ..... 166/278
6,793,017 B2 * 9/2004 Nguyen et al. ..... 166/278
2002/0053439 A1 * 5/2002 Danos ..... 166/380
2002/0125006 A1 * 9/2002 Hailey et al. ..... 166/278
2002/0174984 A1 * 11/2002 Jones ..... 166/278
2002/0189808 A1 12/2002 Nguyen et al.
2003/0089495 A1 5/2003 Bixenman
2003/0183386 A1 * 10/2003 McGregor et al. ..... 166/278
2004/0084187 A1 * 5/2004 Costley et al. ..... 166/312

FOREIGN PATENT DOCUMENTS

WO WO 02/10554 A1 2/2002

* cited by examiner

*Primary Examiner*—David Bagnell
*Assistant Examiner*—Daniel P Stephenson
(74) *Attorney, Agent, or Firm*—Trop, Pruner & Hu P.C.; Bryan P. Galloway; Jaime A. Castano

(57) ABSTRACT

The present invention provides for multiple pathways by which fluid can enter one or more alternate pathway conduits. Entrance tubes can be arranged such that their spacing prevents all of them from being simultaneously obstructed, covered, or otherwise blocked.

30 Claims, 1 Drawing Sheet

MULTIPLE ENTRANCE SHUNT

This application claims the benefit of U.S. Provisional Application No. 60/359,568 filed Feb. 25, 2002.

BACKGROUND

1. Field of Invention

The present invention pertains to shunt tubes used in subsurface well completions, and particularly to shunt tubes having multiple entrances.

2. Related Art

Conduits providing alternate or secondary pathways for fluid flow are commonly used in well completions. The alternate pathways allow fluid to flow past and emerge beyond a blockage in a primary passageway. In prior art embodiments, the single entrance to an alternate pathway conduit could be covered, blocked, or otherwise become inaccessible to the fluid, thereby preventing the alternate pathway conduit from performing its intended function. Such blockage could occur, for example, when the conduit happened to be positioned on the bottom wall of a horizontal bore. Alternatively, if low viscosity fluids are used in an alpha beta wave pack, or should pumping fail, the conduit may become blocked. Therefore, there is a continuing need for improved entrance mechanisms to provide more reliable access to the alternate pathway conduits.

SUMMARY

The present invention provides for multiple pathways by which fluid can enter one or more alternate pathway conduits. Entrance tubes can be arranged such that their spacing prevents all of them from being simultaneously obstructed, covered, or otherwise blocked.

Advantages and other features of the invention will become apparent from the following description, drawings, and claims.

DETAILED DESCRIPTION

Figure 1:
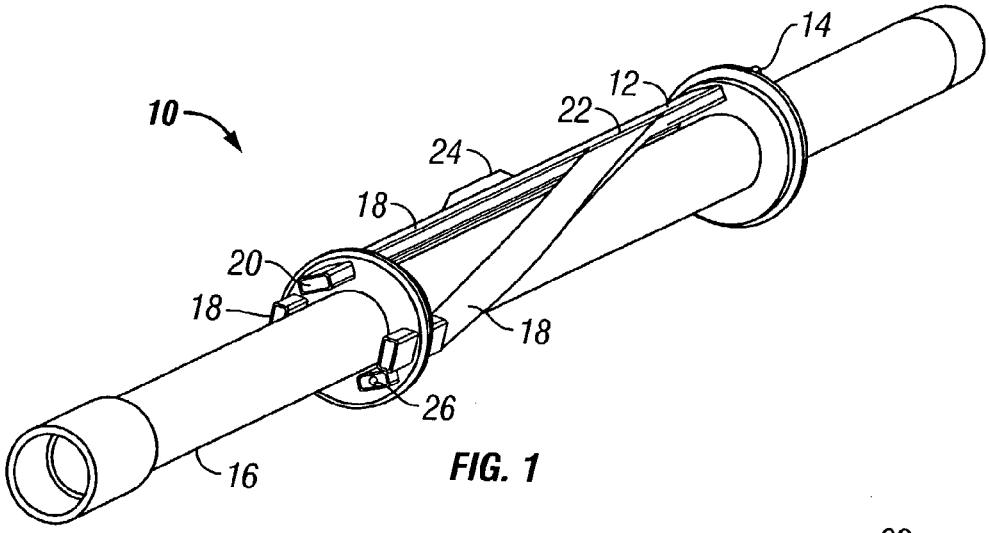
FIG. 1 is a schematic diagram of a portion of a completion assembly constructed in accordance with the present invention.

FIG. 1 shows a portion of a completion assembly 10 used in a well. A shunt tube 12 having a central passageway 14 is mounted on base pipe 16. Only one shunt tube 12 is shown, but there may be more than one. Base pipe 16 may be slotted or perforated base pipe or production tubing. Entrance tubes 18 are also mounted on base pipe 16. Entrance tubes 18 are azimuthally spaced around the circumference of base pipe 16 and connect at their lower ends to shunt tube 12. Those connections could be made using jumper tubes or other connectors known in the art. Each entrance tube 18 has a passageway 20 in fluid communication with central passageway 14 to accommodate fluid flow through entrance tubes 18 and shunt tube 12.

In the embodiment of FIG. 1, entrance tubes 18 are joined at a manifold 22. Entrance tubes 18 may, however, join shunt tube 12 in various places along the length of shunt tube 12, without relation to the junction of shunt tube 12 and other entrance tubes 18. Entrance tubes 18 may also join to more than one shunt tube 12. Entrance tubes 18 may have similar flow capacity to shunt tube 12, or in an alternative embodiment, entrance tubes 18 may have a smaller flow capacity than shunt tube 12. The flow capacities and angle of intersection of entrance tubes 18 with shunt tube 12 is chosen so as to prevent blockage from occurring within entrance tubes 18 or shunt tube 12. That may be a concern, for example, should pumping be halted before a desired operation is completed.

FIG. 1 shows centralizers 24 radially extending from base pipe 16. Centralizers 24 are azimuthally spaced around the circumference of base pipe 16 and serve to keep base pipe 16 approximately centered in the wellbore. Shunt tubes 12 and entrance tubes 18 can be run between centralizers 24 and inside or outside a sand screen. (not shown).

Because shunt tube 12 is an alternate pathway conduit, used to convey fluid past a blockage, it may be desirable to restrict fluid from entering entrance tubes 18 until shunt tube 12 is needed. That could be done by placing restriction members 26 such as valves or rupture discs across the openings of entrance tubes 18. By using rupture discs, for example, flow into entrance tubes 18, and therefore shunt tube 12, would be prevented under normal operating pressures. However, if a blockage (bridging) occurred, pressure in the annular region could be increased until one or more discs burst, allowing fluid to pass.

Figure 2:
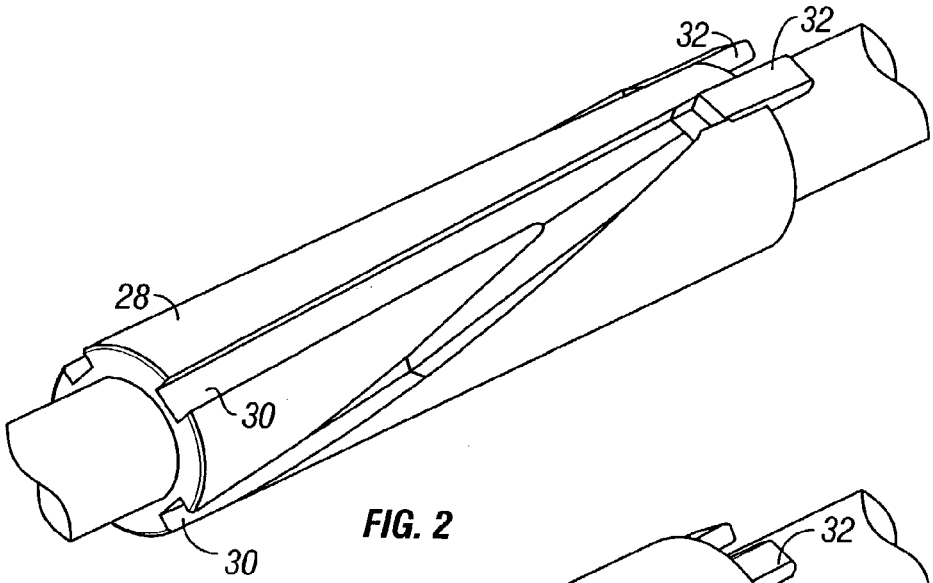
FIG. 2 is a partially cutaway schematic diagram of an alternative embodiment of a completion assembly constructed in accordance with the present invention.
Figure 3:
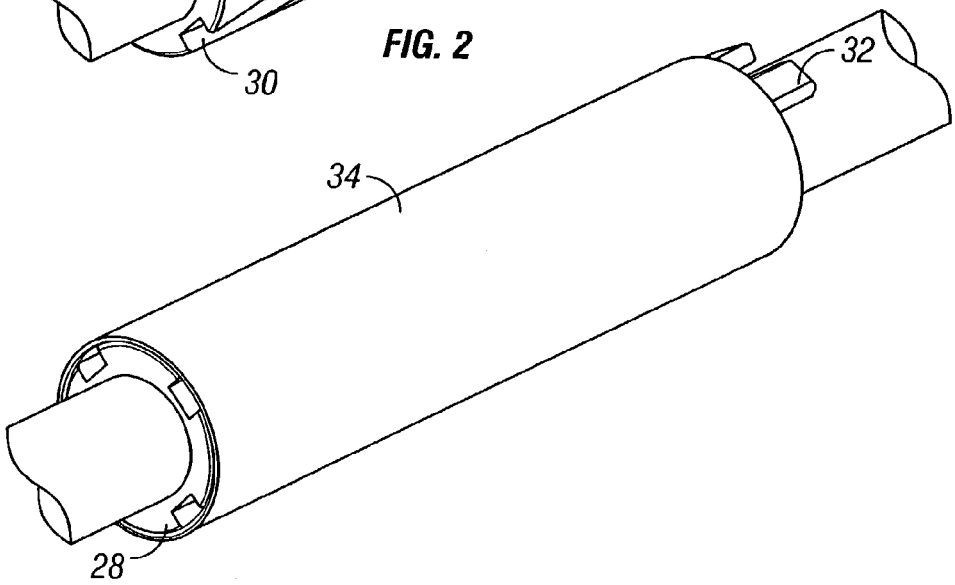
FIG. 3 is a perspective view of the completion assembly of FIG. 2.

FIGS. 2 and 3 shows an alternative embodiment of the present invention. FIG. 2 shows a body 28 having channels 30. Channels 30 can be milled or formed using other conventional methods. Channels 30 form pathways for fluid flow and essentially serve the functions of entrance tubes 18. Channels 30 merge to direct their flow into one or more outlets 32. There may be any number of channels 30, the openings of which are azimuthally spaced. A cover 34 (FIG. 3) is mounted to body 28 to confine the fluid entering a particular channel 30 to travel through that channel 30 until it reaches an outlet 32. Outlets 32 join to sand screen assemblies (not shown) using jumper tubes or other known connectors.

In the embodiment shown in FIGS. 2 and 3, there are four channels 30 (though one channel 30 is obscured from view). Because there are two outlets in this instance, those four channels 30 are divided into pairs. The two channels 30 forming one particular pair merge to direct their fluid to one of the outlets 32. The other pair similarly merges to direct its output to the other outlet 32. Channels 30 can be merged by groups according to the number of outlets 32 available in any particular embodiment. Restriction members 26 can be placed in channels 30 to control access by the fluid until some operational condition is met. In the embodiment of FIGS. 2 and 3, base pipe 16 is preferably not slotted or perforated.

In operation, a fluid such as a gravel slurry or fracturing fluid is pumped into an annular region between a production zone of the well and base pipe 16. Often the fluid is initially pumped through a work string down to a crossover mechanism which diverts the flow into the annular region some distance below the well surface. In any case, when the fluid encounters entrance tubes 18, it flows into entrance tubes 18 and travels through passageway 20. Because entrance tubes 18 are azimuthally arranged, there is always at least one open fluid path through entrance tubes 18 into central passageway 14 of shunt tube 12. That insures the fluid can pass into shunt tube 12.

The operation of the alternative embodiment is similar. The fluid is pumped into the annulus. When bridging occurs, the fluid backs up and the pressure increases. The fluid finds the openings of channels 30 and, in the absence of restrictor devices, flows into channels 30 and into shunt tubes 12. In those embodiments employing restrictor members 26, the fluid may be restricted from passing into the relevant passageway until the restriction member 26 therein is defeated.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A completion assembly for use in a well comprising:

a base pipe having a longitudinal axis;

a shunt tube carried on the base pipe; and a plurality of entrance tubes in fluid communication with the shunt tube, each of the entrance tubes having an inlet and an outlet, each of the entrance tubes extending along an azimuthally varying path with respect to the longitudinal axis of the base pipe so that the inlets are azimuthally spaced around the base pipe and in fluid communication with the shunt tube, and each of the outlets being connected to the shunt tube at a different position along the longitudinal axis.

2. The completion assembly of claim 1 further comprising a manifold onto which the entrance tubes connect at an intake end of the manifold and the shunt tube connects at a discharge end of the manifold.

3. The completion assembly of claim 1 further comprising a restriction member in each of the entrance tubes.

4. The completion assembly of claim 3 in which the restriction member is a rupture disk or valve.

5. The completion assembly of claim 1 further comprising centralizers azimuthally spaced on the base pipe.

6. The completion assembly of claim 1 in which the base pipe has a sidewall with openings therethrough.

7. The completion assembly of claim 1 in which a plurality of shunt tubes are carried on the base pipe.

8. The completion assembly of claim 7 in which the entrance tubes are in fluid communication with more than one shunt tube.

9. The completion assembly of claim 1 in which the individual entrance tubes have a smaller flow capacity than the shunt tube.

10. The completion assembly of claim 1 in which the flow capacities of the entrance tubes and the shunt tube are chosen to prevent blockage therein.

11. The completion assembly of claim 1, wherein each of the entrance tubes has an outlet, and an acute angle of intersection exists between each entrance tube and the shunt tube near the outlet of said each entrance tube.

12. The completion assembly of claim 1, wherein each of the entrance tubes has an outlet, and the outlets of the entrance tubes have the same relative azimuthal position as compared to azimuthal positions of the inlets of the entrance tubes.

13. A fluid transport system for use in a well comprising:

a transport tube having multiple openings to allow fluid entry into the transport tube;

a plurality of entrance tubes having upper and lower ends and in which each lower end is sealingly joined to one of the multiple openings of the transport tube at a different position on the transport tube to establish fluid communication between the entrance tubes and the transport tube; and a base pipe on which the entrance tubes and transport tube are carried, and about which the upper ends of the entrance tubes are circumferentially distributed.

14. The fluid transport system of claim 13 further comprising a restriction member in each of the entrance tubes.

15. The fluid transport system of claim 13 in which the restriction member is a rupture disk or valve.

16. The fluid transport system of claim 13 in which a plurality of transport tubes are carried on the base pipe.

17. The fluid transport system of claim 16 in which the entrance tubes are in fluid communication with more than one transport tube.

18. The fluid transport system of claim 13 in which the base pipe has a sidewall with openings therethrough.

19. The fluid transport system of claim 13 in which the spacing between the upper ends is substantially equal.

20. A method to convey fluid in a well comprising:

providing a plurality of entrance tubes having upper and lower ends, the upper ends of the entrance tubes being circumferentially placed around and carried by a base pipe that has a longitudinal axis;

joining the lower ends of the entrance tubes to a transport tube between an upper end of the transport tube and a lower end of the transport tube to provide fluid communication therethrough, the transport tube being carried by the base pipe and having a passageway that substantially extends along the longitudinal axis of the base pipe;

positioning the base pipe in the well; and pumping the fluid into a region in the well in which the upper ends of the entrance tubes are disposed such that the fluid enters at least one of the entrance tubes and flows through the transport tube.

21. The method of claim 20 further comprising restricting flow through the entrance tube with a restriction member until an operating condition is met.

22. The method of claim 21 further comprising defeating the restriction member once the operating condition is met to allow flow through the entrance tube.

23. A completion assembly for use in a well comprising:

a base pipe;

a shunt tube carried on the base pipe; and a plurality of entrance tubes azimuthally spaced around the base pipe and in fluid communication with the shunt tube, wherein the individual entrance tubes have a smaller flow capacity than the shunt tube.

24. The completion assembly of claim 23, further comprising a manifold, wherein the entrance tubes connect to the manifold at an intake end of the manifold and the shunt tube connects to the manifold at a discharge end of the manifold.

25. The completion assembly of claim 23, further comprising a restriction member in each of the entrance tubes.

26. The completion assembly of claim 25, in which the restriction member comprises a rupture disk or valve.

27. The completion assembly of claim 23 in which the angles of intersection between the entrance tubes and the shunt tube are chosen to prevent blockage therein.

28. A fluid transport system for use in a well, comprising:

a transport tube having multiple openings to allow fluid entry into the transport tube;

a plurality of entrance tubes having upper and lower ends and in which each lower end is sealingly joined by a jumper tube to one of the multiple openings of the transport tube thereby establishing fluid communication between the entrance tubes and the transport tube; and a base pipe on which the entrance tubes and transport tube are carried, and about which the upper ends of the entrance tubes are circumferentially distributed.

29. The fluid transport system of claim 28, further comprising a restriction member in each of the entrance tubes.

30. The fluid transport system of claim 28, in which the restriction member comprises a rupture disk or valve.

* * * * *